US007789998B2

(12) United States Patent
Crook et al.

(10) Patent No.: US 7,789,998 B2
(45) Date of Patent: Sep. 7, 2010

(54) PRESS FABRIC SEAM AREA

(75) Inventors: Robert Crook, Wilson, NC (US); Sanjay Patel, Summerville, SC (US); Clifton Wilder, Sims, NC (US)

(73) Assignee: Voith Patent GmbH, Heidenheim (DE)

( * ) Notice: Subject to any disclaimer, the term of this patent is extended or adjusted under 35 U.S.C. 154(b) by 655 days.

(21) Appl. No.: 11/673,085

(22) Filed: Feb. 9, 2007

(65) Prior Publication Data

US 2008/0190580 A1 Aug. 14, 2008

(51) Int. Cl.
*D21F 7/10* (2006.01)

(52) U.S. Cl. ..... 162/358.2; 162/904; 428/58; 428/194; 156/304.1; 156/331.7; 156/283; 156/285; 156/304.6

(58) Field of Classification Search ..... 162/348, 162/358.2, 900, 902–904, 358.1; 428/57, 428/58, 61, 192–194; 28/141, 142; 139/383 AA; 156/251, 275.1, 308.1, 308.4, 544–546, 331.7, 156/283, 285, 304.6, 304.1; 442/270, 275, 442/277, 281
See application file for complete search history.

(56) References Cited

U.S. PATENT DOCUMENTS 4,357,386 A * 11/1982 Luciano et al. ..... 442/30
4,569,883 A * 2/1986 Renjilian ..... 442/194
4,571,359 A * 2/1986 Dutt ..... 442/324
4,847,116 A * 7/1989 Duit ..... 427/195
4,948,646 A 8/1990 Lasinsky et al. ..... 428/60
4,958,673 A 9/1990 Dufour ..... 162/358
5,041,332 A 8/1991 Lasinsky ..... 428/58
5,082,532 A 1/1992 Dufour ..... 162/358
5,360,518 A * 11/1994 McCarthy et al. ..... 162/358.2
5,508,095 A * 4/1996 Allum et al. ..... 442/60
5,789,052 A 8/1998 Miller et al. ..... 428/57
6,017,583 A 1/2000 Gass
2002/0060058 A1 * 5/2002 Crook ..... 162/903
2004/0016473 A1 1/2004 Hansen
2005/0124248 A1 6/2005 Hyvonen

* cited by examiner

*Primary Examiner*—Eric Hug
(74) *Attorney, Agent, or Firm*—Taylor IP, PC

(57) ABSTRACT

A pinseam press fabric is smoothed in the area of the seam by depositing polyurethane particles having a size of about 1 to 500 micrometers across the seam of the felt defined by the ends of the fabric. The polyurethane particles are drawn into the seam end by the application of a vacuum. Once the particles are deposited, the fabric is heated so that the polyurethane particles melt to form a polymeric matrix.

14 Claims, 1 Drawing Sheet

PRESS FABRIC SEAM AREA

BACKGROUND OF THE INVENTION

1. Field of the Invention

This invention relates to seamed press fabric and has particular reference to a seamed press fabric modified to reduce or substantially eliminate marking of a paper sheet by the fabric during production of the paper.

2. Description of the Related Art

Conventionally, papermaking machines have three basic sections: the forming section, the wet press section, and the drying section. In the forming section, paper pulp, which is almost liquid, is introduced onto a permeable forming fabric. The forming fabric transports the aqueous paper pulp across suction boxes thereby forming an aqueous paper web or sheet having a concentration of approximately 20% dry matter, essentially cellulose or similar fibers.

The aqueous paper web is then transported on fabrics known as wet felts, between press rolls in the wet press section of the papermaking machinery. Such a felt generally comprises, an open-mesh base fabric having at least one batt needled thereto. The pressure of the press rolls causes the water to leave the paper web; the water runs through the interstices of the wet felts. Wet felts are designed such that marking and crushing of the aqueous paper web is avoided during the dewatering process.

The paper web exits the wet section of the papermaking equipment as a sheet of approximately 45% dry matter. Thereafter, the paper sheet is carried on fabrics, known as dryer felts, through the drying section of the papermaking equipment where more water is removed through evaporation as the paper is transported around heated rollers.

In the dryer section of the papermaking equipment, the paper sheet is more resistant to marking. Conventional techniques for seaming papermaker's fabrics for the dryer section of the papermaking machine have proven satisfactory.

In contrast with the dryer section, the aqueous paper web is much softer as it passes through the wet section of the papermaking equipment. Accordingly, the risk of marking the paper is much greater. Any variation in the thickness, composition, or surface texture of the papermaker's fabric may cause marking of the aqueous web as it passes through the press rollers.

It will be appreciated that difficulty arises in the jointing of press felts since either the felts are made in a tubular fashion, or felts are made in longitudinal lengths and which need to be joined. Hitherto, only felts which are woven as endless felts have been acceptable since this tends to overcome the substantial discontinuity occasioned by other types of press felt joints. As an alternative to endless felts, loop seams in press felts have been proposed, for example, in U.S. Pat. Nos. 2,883,734 and 2,907,093, but because of the nature of the loops and seam area, it is almost inevitable that, marking of the paper web is possible as it passes a nip. With woven, single layer felts, there is little protection between the seam loops and a paper web.

Straight joints have also been proposed by securing butt edges with a backing sheet, but again this produces a hardness in the nip which causes the marking of the paper.

Seamed press felts are gaining popularity in the paper industry because they allow for easier installation and reduce paper machine down time. However, their utility has been limited due to the tendency of flap wear and sheet marking.

There is a need in the art to provide a seamed press felt that has minimum, if not an absence, of paper marking.

SUMMARY OF THE INVENTION

In one form, the invention relates to a method for reinforcing the seam of a pinseam press fabric having the steps of joining the ends of an elongated press fabric so that the fabric forms an endless belt capable of resisting tension. Polyurethane particles having a size of about 1 μm to 500 μm are deposited across the seam of the felt defined by the ends of the fabric, and the polyurethane particles are heated to adhere to the fabric forming a polymeric matrix.

In another from, the invention relates to a pinseam press fabric formed from an elongated press fabric joined at its ends of so that the fabric forms an endless belt capable of resisting tension. Polyurethane particles having a size of about 1 μm to 500 μm are deposited across the seam of the felt defined by the ends of the fabric, the polyurethane particles being heated to adhere to the fabric forming a polymeric matrix.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawing, wherein.

Corresponding reference characters indicate corresponding parts throughout the several views. The exemplification set out herein illustrates one embodiment of the invention and such exemplification is not to be construed as limiting the scope of the invention in any manner.

DETAILED DESCRIPTION OF THE INVENTION

Figure 1:
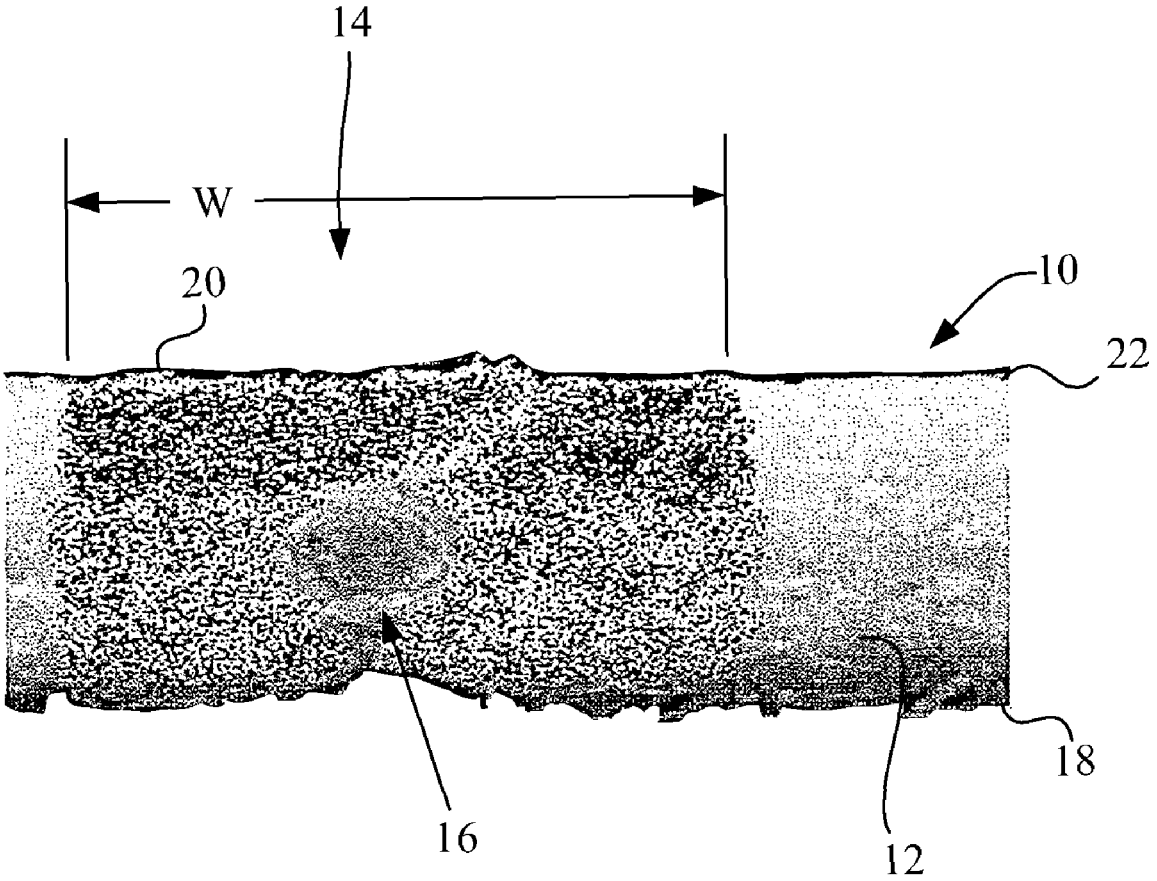
FIG. 1 show an enlarged cross-section view of a pinseam press fabric embodying the present invention.

Referring now to FIG. 1, there is shown a press fabric 10 used in the manufacture of fibrous material and, especially paper, as well as other fiberous web products. Press fabric 10 comprises a plurality of yarns 12 shown in highly magnified form in FIG. 1. Yarns 12 are woven together to form an endless belt (not shown). The view of FIG. 1 shows only the area adjacent a seam 14 for purposes of simplifying the discussion of the present invention. The individual yarns 12 are woven together or looped around a pintel 16 that extends in the cross machine direction (CMD). The yarns 12 are looped about the pintel 16 and appropriately secured so that the press fabric 10 can be operated in a belt form and is capable of resisting tension when it presses moisture out of a fibrous web. The ends of the yarns 12 are joined together in the manufacturing process. At least the width W of the fabric 10 is subjected to a vacuum on the bottom side 18 and a series of polyurethane particles 20 are applied to the upper side 22 with the vacuum drawing the particles 20 into the recess adjacent the seam 14 of the press fabric 10. The polyurethane particles have a size from about 1 to 500 micrometers (μm) and are suspended in solution to be deposited in the felt structure. The width W ranges from 10 to 40 millimeters with 20 millimeters being preferred. After the vacuum has pulled the particles into the felt structure, heat is applied to melt the polyurethane particles which then adhere to the fibers and yarns to form a polymeric matrix having a smooth upper surface 22 that is substantially indistinguishable from the remainder of the press fabric 10. While the preferred particle size of the polyurethane particles 20 is 1 to 100 micrometers, larger particle sizes up to 500 micrometers may be used for coarser construction press fabrics. The quantity of polyurethane particles used in the seam area can range from 10 to 200 grams per square meter (gsm). The preferred embodiment has a polyurethane particle quantity of 90 to 150 gsm. The melting temperature of the polyurethane particles ranges from 125° C. to 180° C. The preferred embodiment employs polyurethane particles with a melting temperature of 125° C. to 162° C. The polyurethane solution may be a mixture of polyurethanes with different melting temperatures. For example, the mixture may employ equal parts of polyurethane having a melting temperature of 125° C. and another with a melting temperature of 162° C. The preferred width W for the application of the polyurethane solution is 20 millimeters across the seam of the press felt within the distance W.

The application of the polyurethane particles results in a upper surface 22 contacting the paper that is substantially as smooth as the remainder of the press fabric 10 to minimize, if not eliminate, the problems with seam mark. It has been found that the porosity of the press fabric in the area W is found to be within 10% of the remainder of the press fabric 10 to provide substantially uniform porosity over the length of the belt.

The polyurethane particles are heated using conventional heaters to provide the melting of the urethane into the polymeric matrix.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A method for smoothing the seam of a pinseam press fabric comprising the steps of:

joining the ends of an elongated press fabric so that the fabric forms an endless belt capable of resisting tension, depositing polyurethane particles having a size of about 1μ to 500μ across the seam of the belt defined by the ends of the fabric, applying a vacuum to the fabric to pull said polyurethane particles into the fabric across the seam, and heating the polyurethane particles to adhere to the fabric forming a polymeric matrix.

2. A method as claimed in claim 1 wherein said polyurethane particles are deposited to a width of about 10 mm to about 30 mm.

3. A method as claimed in claim 1 wherein the amount of polyurethane deposited is about 10 grams per square meter (gsm) to about 200 gsm.

4. A method as claimed in claim 1 wherein the particle size of said polyurethane is about 1μ to about 100μ.

5. A method as claimed in claim 1 wherein the amount of polyurethane particles deposited is about 90 grams per square meter (gsm) to about 150 gsm.

6. A method as claimed in claim 1 wherein said polyurethane particles are heated to about 125° C. to about 180° C.

7. A method as claimed in claim 1 wherein said polyurethane particles are heated to about 125° C. to about 162° C.

8. A method as claimed in claim 1 wherein said polyurethane particles are a mixture of polyurethane particles having different melting temperatures.

9. A method as claimed in claim 1 wherein said polyurethane particles are deposited to a width of about 20 mm.

10. A method as claimed in claim 1 wherein the particle size of said polyurethane is about 1μ to about 100μ.

11. A method as claimed in claim 10 wherein said polyurethane particles are heated to about 125° C. to about 180° C.

12. A method as claimed in claim 10 wherein said polyurethane particles are heated to about 125° C. to about 162° C.

13. A method as claimed in claim 10 wherein said polyurethane particles are a mixture of polyurethane particles having different melting temperatures.

14. A method for smoothing the seam of a pinseam press fabric comprising the steps of:

joining the ends of an elongated press fabric so that the fabric forms an endless belt capable of resisting tension, depositing polyurethane particles having a size of about 1μ to 500μ across the seam of the belt defined by the ends of the fabric to a width of about 10 mm to about 30 mm, and heating the polyurethane particles to adhere to the fabric forming a polymeric matrix.

* * * * *